US010343028B2

(12) United States Patent
Betz

(10) Patent No.: US 10,343,028 B2
(45) Date of Patent: Jul. 9, 2019

(54) GOLF EQUIPMENT CLEANER

(71) Applicant: Brian Betz, Logan, UT (US)

(72) Inventor: Brian Betz, Logan, UT (US)

( * ) Notice: Subject to any disclaimer, the term of this patent is extended or adjusted under 35 U.S.C. 154(b) by 297 days.

(21) Appl. No.: 15/345,109

(22) Filed: Nov. 7, 2016

(65) Prior Publication Data

US 2017/0072271 A1 Mar. 16, 2017

Related U.S. Application Data

(63) Continuation-in-part of application No. 14/597,451, filed on Jan. 15, 2015, now abandoned.

(60) Provisional application No. 61/927,825, filed on Jan. 15, 2014.

(51) Int. Cl.

| | |
|---|---|
| ***B08B 3/04*** | (2006.01) |
| ***A47L 25/00*** | (2006.01) |
| ***A63B 47/04*** | (2006.01) |
| ***A63B 57/60*** | (2015.01) |
| *A46B 17/00* | (2006.01) |
| *B08B 1/00* | (2006.01) |

(52) U.S. Cl.

CPC ..... *A63B 47/04* (2013.01); *A47L 25/00* (2013.01); *A63B 57/60* (2015.10); *B08B 3/04* (2013.01); *A46B 17/00* (2013.01); *B08B 1/00* (2013.01)

(58) Field of Classification Search

CPC ..... A47L 25/00; A63B 47/04; A63B 57/60; B08B 3/04

See application file for complete search history.

(56) References Cited

U.S. PATENT DOCUMENTS

| | | | | |
|---|---|---|---|---|
| 2,530,746 | A * | 11/1950 | Wetherby | A63B 47/04 15/104.002 |
| 2,968,825 | A | 1/1961 | Wetherby | |
| 3,406,419 | A | 10/1968 | Young | |
| 3,583,018 | A | 6/1971 | Fink | |
| 4,510,640 | A | 4/1985 | Omori | |
| 4,971,126 | A | 11/1990 | Borenstein | |
| 5,146,968 | A | 9/1992 | Meek | |
| 5,215,136 | A | 6/1993 | Flanders et al. | |
| 5,394,914 | A | 3/1995 | Meek | |
| 5,615,720 | A | 4/1997 | O'Sullivan | |
| 5,770,284 | A | 6/1998 | Logemann | |
| 5,893,190 | A | 4/1999 | Mertz | |

(Continued)

FOREIGN PATENT DOCUMENTS

| | | | | |
|---|---|---|---|---|
| GB | 2313065 | A * | 11/1997 | A63B 47/04 |
| WO | 2004/016518 | A1 | 2/2004 | |

*Primary Examiner* — Laura C Guidotti

(74) *Attorney, Agent, or Firm* — Kunzler Bean & Adamson

(57) ABSTRACT

An apparatus for cleaning golf equipment. The apparatus includes a flexible outer layer shaped to form an exterior surface of a pouch, a flexible inner layer shaped to form an interior surface of the pouch, and a water impermeable layer disposed between the flexible outer layer and the flexible inner layer, with each having edges that are coupled together to form an opening of the pouch. The flexible inner layer is made from a textured fabric for wet-cleaning golf equipment and the flexible outer layer may also be made from a textured fabric for drying and dry-cleaning the golf equipment. The apparatus includes an anti-wicking barrier disposed on the interior surface. The anti-wicking barrier may prevent moisture from inside the pouch from escaping the pouch.

17 Claims, 10 Drawing Sheets

(56) References Cited

U.S. PATENT DOCUMENTS

| | | | | |
|---|---|---|---|---|
| 5,898,968 | A | 5/1999 | Beattie | |
| 6,076,224 | A | 6/2000 | Pacifico et al. | |
| 6,192,543 | B1 | 2/2001 | Lee | |
| 6,216,305 | B1 | 4/2001 | Joh | |
| 6,226,827 | B1 | 5/2001 | English, Jr. | |
| 6,233,774 | B1 * | 5/2001 | Vogt | A63B 47/04 15/104.93 |
| 6,560,812 | B1 | 5/2003 | Pettway | |
| 6,594,851 | B2 | 7/2003 | Sprague | |
| 6,745,424 | B1 | 6/2004 | Pimentel et al. | |
| 6,858,281 | B2 | 2/2005 | Kim | |
| 7,219,388 | B2 | 5/2007 | Hale | |
| 7,302,728 | B2 | 12/2007 | Kunz | |
| 7,356,868 | B1 | 4/2008 | Herrmann | |
| 7,484,262 | B2 | 2/2009 | Cotton | |
| 7,797,783 | B2 | 9/2010 | Chandler et al. | |
| 8,171,593 | B2 | 5/2012 | Sprague | |
| 8,297,866 | B2 | 10/2012 | de Gery | |
| 8,844,588 | B2 | 9/2014 | Low et al. | |
| 2003/0005535 | A1 | 1/2003 | Hale | |
| 2004/0016071 | A1 | 1/2004 | Ayala | |
| 2006/0059644 | A1 | 3/2006 | Steele | |
| 2007/0039111 | A1 | 2/2007 | Curtis | |
| 2007/0068612 | A1 | 3/2007 | Potter | |
| 2007/0169297 | A1 | 7/2007 | Wade | |
| 2009/0031517 | A1 | 2/2009 | Hollows et al. | |
| 2010/0199451 | A1 | 8/2010 | Taylor | |
| 2015/0082513 | A1 | 3/2015 | Wisemann et al. | |
| 2015/0082514 | A1 | 3/2015 | Wisemann et al. | |

* cited by examiner

GOLF EQUIPMENT CLEANER

CROSS REFERENCES TO RELATED APPLICATIONS

This application is a continuation-in-part of Ser. No. 14/597,451, filed Jan. 15, 2015.

FIELD

The subject matter disclosed herein relates to cleaning equipment and more particularly relates to a golf equipment cleaner.

BACKGROUND

Golf equipment, such as golf balls and clubs, may become dirty with use. Dirty golf equipment may not be as effective when used. Golfers usually desire a way to clean their golf equipment that is convenient and easy.

SUMMARY

An apparatus is disclosed. The apparatus may be for cleaning golf equipment. In one embodiment, the apparatus may include a flexible outer layer shaped to form an exterior surface of a pouch. The flexible outer layer may include an edge. The apparatus may include a flexible inner layer shaped to form an interior surface of the pouch. The flexible inner layer may include an edge. The flexible inner layer may include a textured fabric for wet-cleaning golf equipment. The apparatus may include a water impermeable layer disposed between the flexible outer layer and the flexible inner layer. The water impermeable layer may include an edge and may be shaped to form an internal barrier of the pouch. The apparatus may include a collar coupling the edges of the flexible outer layer, the flexible inner layer, and the water impermeable layer to form an opening of the pouch. The apparatus may include a water impermeable surface disposed inside the pouch. The water impermeable surface may be disposed between the collar and the flexible inner layer. Water may be retainable within the pouch.

In one embodiment, an apparatus is disclosed. The apparatus may include a water impermeable membrane shaped to form a pouch. The pouch may include an opening, side-walls, and a bottom. The apparatus may include a textured fabric layer lining interior surfaces of the side-walls and the bottom of the pouch. The apparatus may include a collar that may couple the textured fabric layer to the water impermeable membrane and may border the opening of the pouch. The apparatus may include a water impermeable surface disposed inside the pouch. The water impermeable surface may be disposed between the collar and the textured fabric layer.

In one embodiment, a method is disclosed. The method may include providing a flexible outer layer shaped to form an exterior surface of a pouch. The flexible outer layer may include an edge. The method may include providing a flexible inner layer shaped to form an interior surface of the pouch. The flexible inner layer may include an edge. The flexible inner layer may include a textured fabric for wet-cleaning golf equipment. The method may include providing a water impermeable layer disposed between the flexible outer layer and the flexible inner layer. The water impermeable layer may include an edge and may be shaped to form an internal barrier of the pouch. The method may include providing a collar that may couple the edges of the flexible outer layer, the flexible inner layer, and the water impermeable layer to form an opening of the pouch. The method may include providing a water impermeable surface disposed inside the pouch. The water impermeable surface may be disposed between the collar and the flexible inner layer. The method may include putting an amount of water into the pouch, inserting a piece of golf equipment through the opening into the pouch, and/or cleaning the piece of golf equipment using the flexible inner layer and the amount of water in the pouch.

BRIEF DESCRIPTION OF THE DRAWINGS

In order that the advantages of the subject matter may be more readily understood, a more particular description of the subject matter briefly described above will be rendered by reference to specific embodiments that are illustrated in the appended drawings. Understanding that these drawings depict only typical embodiments of the subject matter and are not therefore to be considered to be to scale or to be limiting of its scope, the subject matter will be described and explained with additional specificity and detail through the use of the drawings, in which.

DETAILED DESCRIPTION

The subject matter of the present application has been developed in response to the present state of the art, and in particular, in response to the problems and needs in the art that have not yet been fully solved by currently available fluid receivers. Accordingly, the subject matter of the present application has been developed to provide a fluid receiver that overcomes at least some shortcomings of the prior art.

Described herein are various embodiments of a cleaner for golf equipment. The term "equipment" may refer to pieces of sporting equipment, such as a golf ball or a golf club, used to play the game of golf. Golfers often clean golf balls and clubs to remove dirt, debris, and/or stains from their golf balls. Having a clean golf ball or golf club has several advantages. One such advantage is the improved ability to spot the golf ball in flight or in the grass after the golf ball lands. A dirty golf ball tends to not stand out as much. Additionally, dirt or debris can affect the rolling and flight characteristics of the golf ball, for example, keeping the golf ball from rolling or flying straight, which is important in both putting and driving the golf ball. Beneficially, the below described golf equipment cleaner is formed of multiple layers that provide a moist, inner cleaning surface, an outer drying surface, and a moisture barrier disposed between the inner and outer layers, as will be described below in greater detail.

Figure 1:
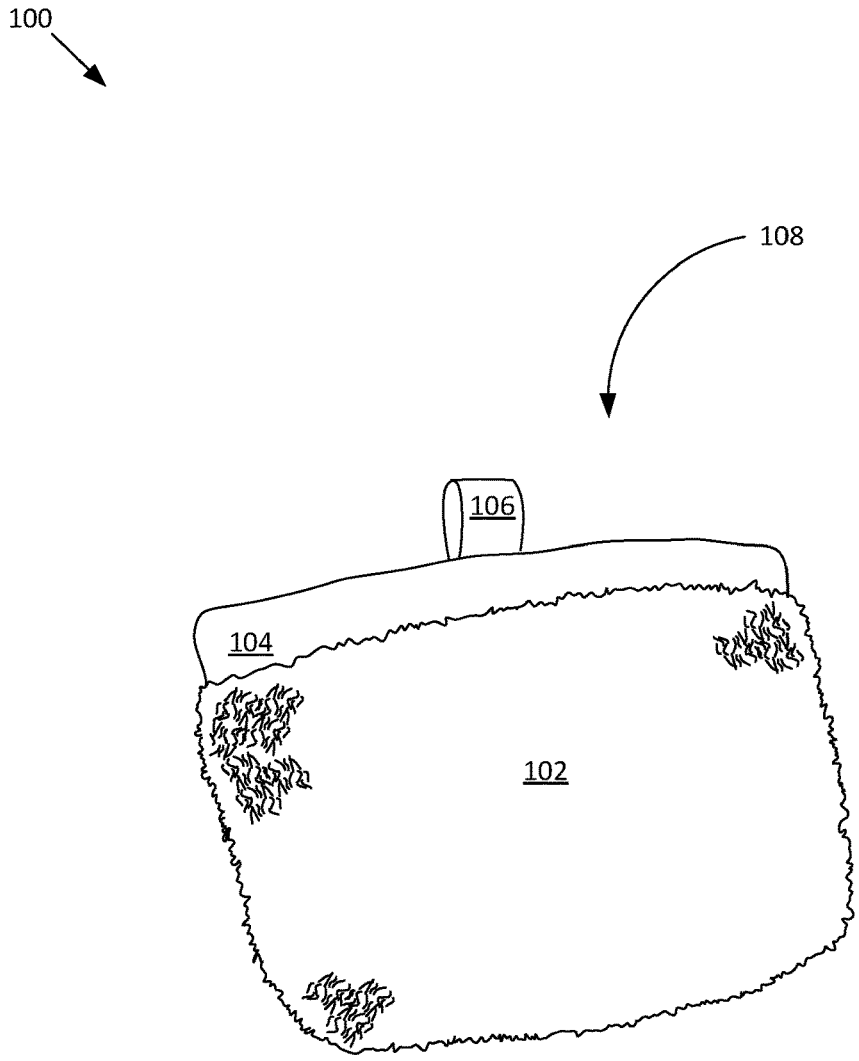
FIG. 1 is a perspective view diagram illustrating one embodiment of a golf equipment cleaner in accordance with embodiments of the invention.

FIG. 1 is a perspective view diagram illustrating one embodiment of a golf equipment cleaner 100 in accordance with embodiments of the invention. The golf equipment cleaner 100 is configured, in one embodiment, to provide multiple cleaning surfaces. In one embodiment, the golf equipment cleaner 100 includes an outer cleaning surface 102 and an inner cleaning surface (see, for example, FIGS. 2 and 3). The golf equipment cleaner 100 may be formed as a pouch, bag, sack, or other type of receptacle having an opening for receiving golf equipment such as golf balls or golf clubs. A collar 104 may form the perimeter of the opening as will be described in greater detail below. In a further embodiment, the golf equipment cleaner 100 may also include a strap 106 for attaching the golf equipment cleaner 100 to another device by way of a hook, carabiner, snap, or other fastener.

In certain embodiments, the outer cleaning surface 102 is formed of a cloth-like material selected to optimally clean golf equipment. One example of a cleaning material includes, but is not limited to, a stranded material such as a microfiber cloth made from polyesters, polyamides, or a combination of polyester, polyamide, and polypropylene. In other embodiments, the outer cleaning surface 102 is a fabric having loops, such as a terry cloth, woven of a natural and/or a synthetic material. In some embodiments, the texture of the outer cleaning surface 102 is selected to aid in the cleaning of golf equipment. As described above, the outer cleaning surface 102 may be utilized to dry golf equipment following insertion into the golf equipment cleaner 100. Additionally, the outer cleaning surface 102 may be utilized for wiping sweat from the hands or face of a golfer.

The material of the outer cleaning surface 102 may be of any color. In other words, the outer cleaning surface may be a single color, multiple colors, etc. Additionally, logos of sports teams or companies, for example, may be embedded, embroidered, or otherwise attached to the outer cleaning surface 102 at any desired position.

The collar 104, in one embodiment, is formed of a nylon webbing or strap that extends around the perimeter of the opening 108. The collar 104 is configured to bind together edges of the outer cleaning surface 102 and the inner cleaning surface. Stated differently, a length of nylon strap may be folded over along a longitudinal axis, with one of the lateral edges (or long, side edges) attached to the outer cleaning surface 102, and the opposing lateral edge attached to the inner cleaning surface. In a further embodiment, the strap 106 is formed of a material similar to the collar 104, or in other words, a similar nylon strap.

Figure 2:
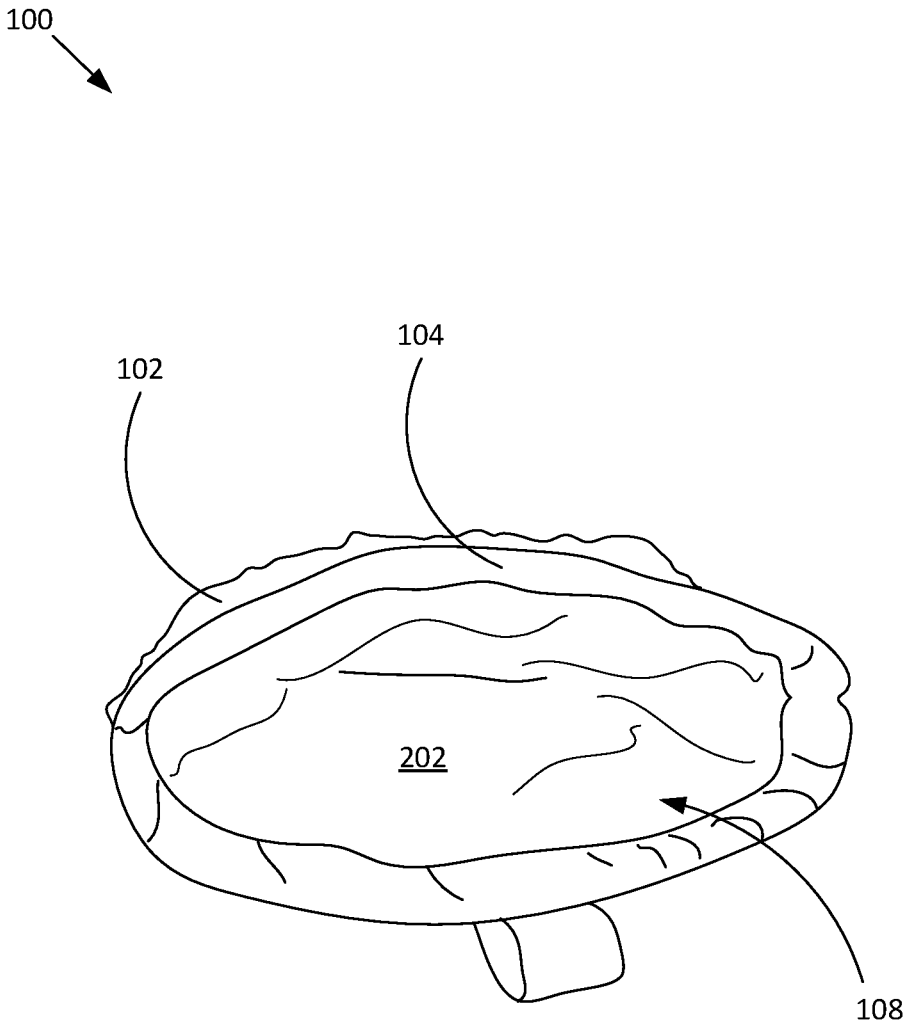
FIG. 2 is a top perspective view diagram illustrating one embodiment of the golf equipment cleaner in accordance with embodiments of the invention.

FIG. 2 is a top perspective view diagram illustrating one embodiment of the golf equipment cleaner 100 in accordance with embodiments of the invention. The golf equipment cleaner 100, as depicted, is formed with an opening 108 for receiving golf equipment such as golf balls or golf clubs. The opening 108 is ringed, as described above, by the collar 104. The collar 104, in one embodiment, binds together the outer cleaning surface 102 and the inner cleaning surface 202.

The inner cleaning surface 202 may be formed, as previously described, by a textured fabric. The textured fabric may include a fabric described above in relation to the outer cleaning surface 102. Examples of a textured fabric include, but are not limited to, synthetic or natural cloths such as terry cloths, microfiber cloths, nylon, neoprene, spandex, a cloth with integrated gripping or scrubbing material, or the like. The inner cleaning surface 202 is configured to be water absorbent. The textured fabric of the inner cleaning surface 202 is selected to retain water. A moist inner cleaning surface 202, beneficially, helps with the removal of dirt and debris from golf equipment.

The inner cleaning surface 202, in one embodiment, is attached to the outer cleaning surface 102 via the collar 104 near the opening 108. Accordingly, the inner cleaning surface 202 may be pulled through the opening 108 to allow for access to the inner cleaning surface. This access may be useful for cleaning the inner cleaning surface 202 by, for example, hand or machine washing the inner cleaning surface 202, and/or allowing the inner cleaning surface 202 to air dry. Additionally, stitching together the inner cleaning surface 202 and the outer cleaning surface 102 may puncture a water retaining membrane disposed between the inner cleaning surface and the outer cleaning surface. (See FIG. 3). In an alternative embodiment, the inner cleaning surface 202 may be coupled to the outer cleaning surface 102.

Figure 3:
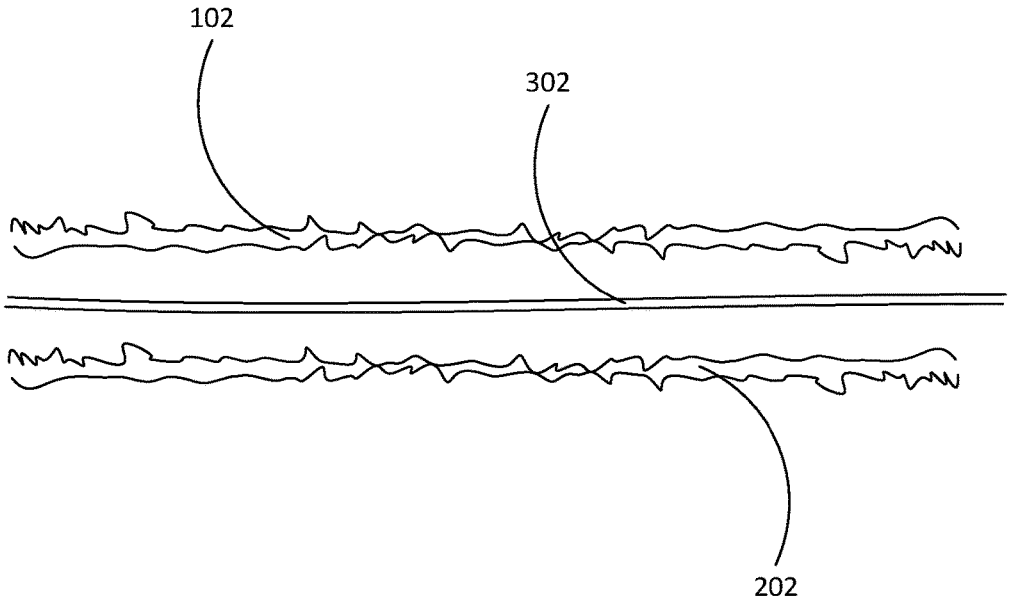
FIG. 3 is a cross-sectional diagram illustrating one embodiment of the outer cleaning surface, the inner cleaning surface, and a moisture barrier disposed between the inner and outer cleaning surfaces.

FIG. 3 is a cross-sectional diagram illustrating one embodiment of the outer cleaning surface 102, the inner cleaning surface 202, and a moisture barrier 302 disposed between the inner and outer cleaning surfaces 202, 102. The moisture barrier 302, like the inner and outer cleaning surfaces 202, 102 may be formed of a water impermeable polymer material. One example of a moisture barrier 302 includes, but is not limited to, vinyl, or any other thin and flexible impermeable material. The moisture barrier 302 is effective to allow the inner cleaning surface 202 to retain moisture over a period of a few hours or a day. Accordingly, a golfer is able to use the golf equipment cleaner 100 without constantly adding water to the golf equipment cleaner 100.

Each of the moisture barrier 302, inner cleaning surface 202, and the outer cleaning surface 102 may be attached to each other at the collar 104. In this embodiment, the three surfaces or layers are coupled to the collar 104 to form a pouch, or bag.

Figure 4:
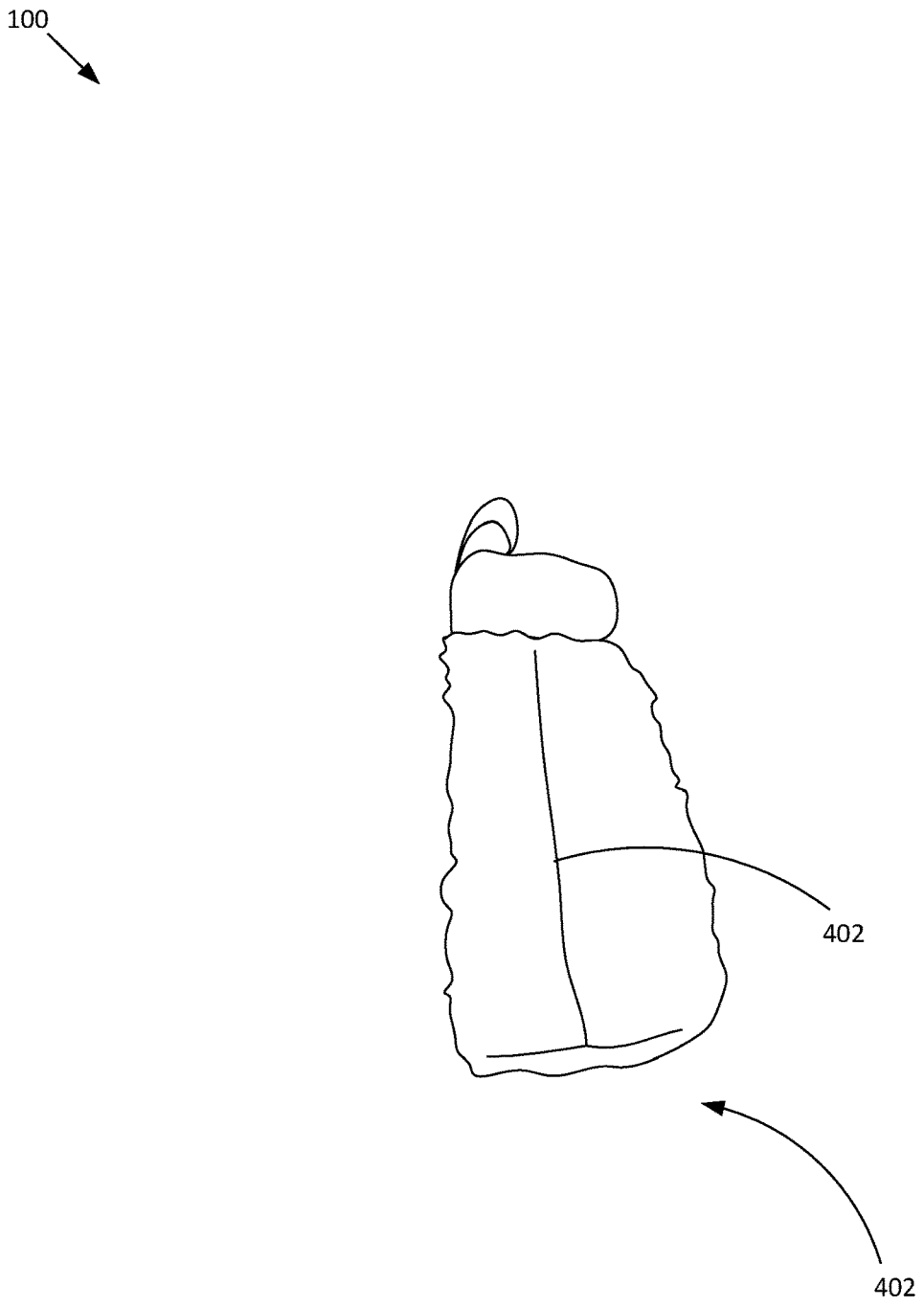
FIG. 4 is a side perspective view diagram of the golf equipment cleaner in accordance with embodiments of the invention.

FIG. 4 is a side perspective view diagram of the golf equipment cleaner 100 in accordance with embodiments of the invention. In the depicted embodiment, the golf equipment cleaner 100 is formed with a substantially square base 402. As will be described below with reference to FIG. 5, the inner and outer cleaning layers may be formed by stitching together sheet in a fashion depicted with a "T" stitch 404. The T stitch 404 allows the golf equipment cleaner 100 to have a square base which is useful for adding a cleaning appliance (e.g., a brush) to the golf equipment cleaner 100 (see FIG. 6).

Figure 5:
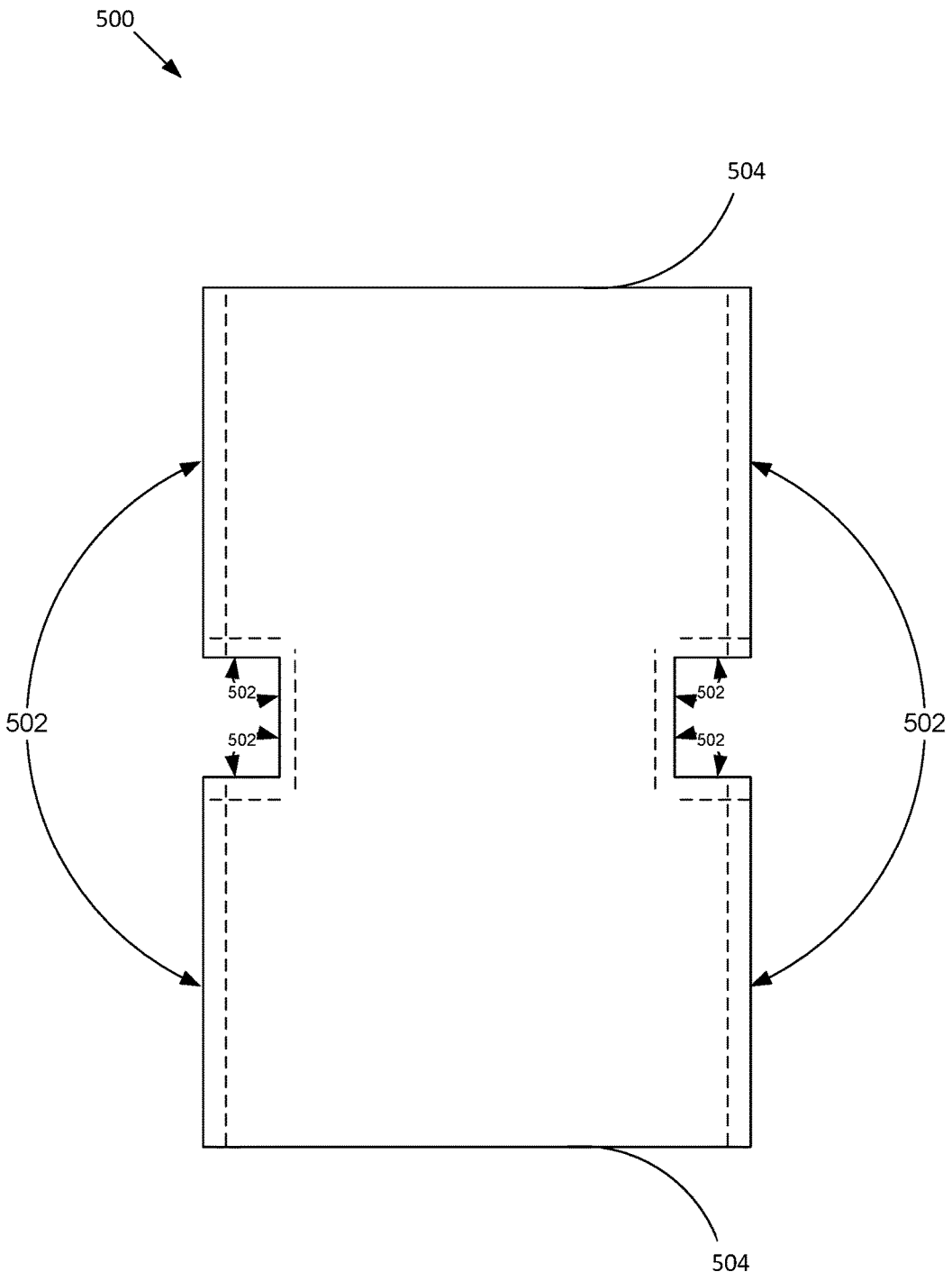
FIG. 5 is a schematic block diagram illustrating one embodiment of a cleaning surface template in accordance with embodiments of the invention.

FIG. 5 is a schematic block diagram illustrating one embodiment of a cleaning surface template 500 in accordance with embodiments of the invention. The cleaning surface template 500 is one example of a sewing pattern for assembling the golf equipment cleaner 100, and is not intended to be limiting. In other words, it is contemplated that other templates 500 may be utilized to form the inner and outer cleaning layers. In the depicted embodiment, the dashed lines are indicative of sewing lines if the edges were to be stitched together. Alternatively, the edges of the template 500 may be joined via any suitable method including adhesives, hook and loop, etc.

Arrows 502 indicate edges that may be joined together. In one embodiment, the collar 104 attaches to edge 504 to form the opening of the golf equipment cleaner 100. Edge 504 may have a length in the range of between about 4 and 12 inches. In a further embodiment, the edge 504 has a length of about 8 inches. In another embodiment, the edge 504 has a length selected according to the size of golf equipment that will be inserted into the opening formed by the edges 504. The distance between edges may be in the range of between about 4 and 20 inches.

Figure 6:
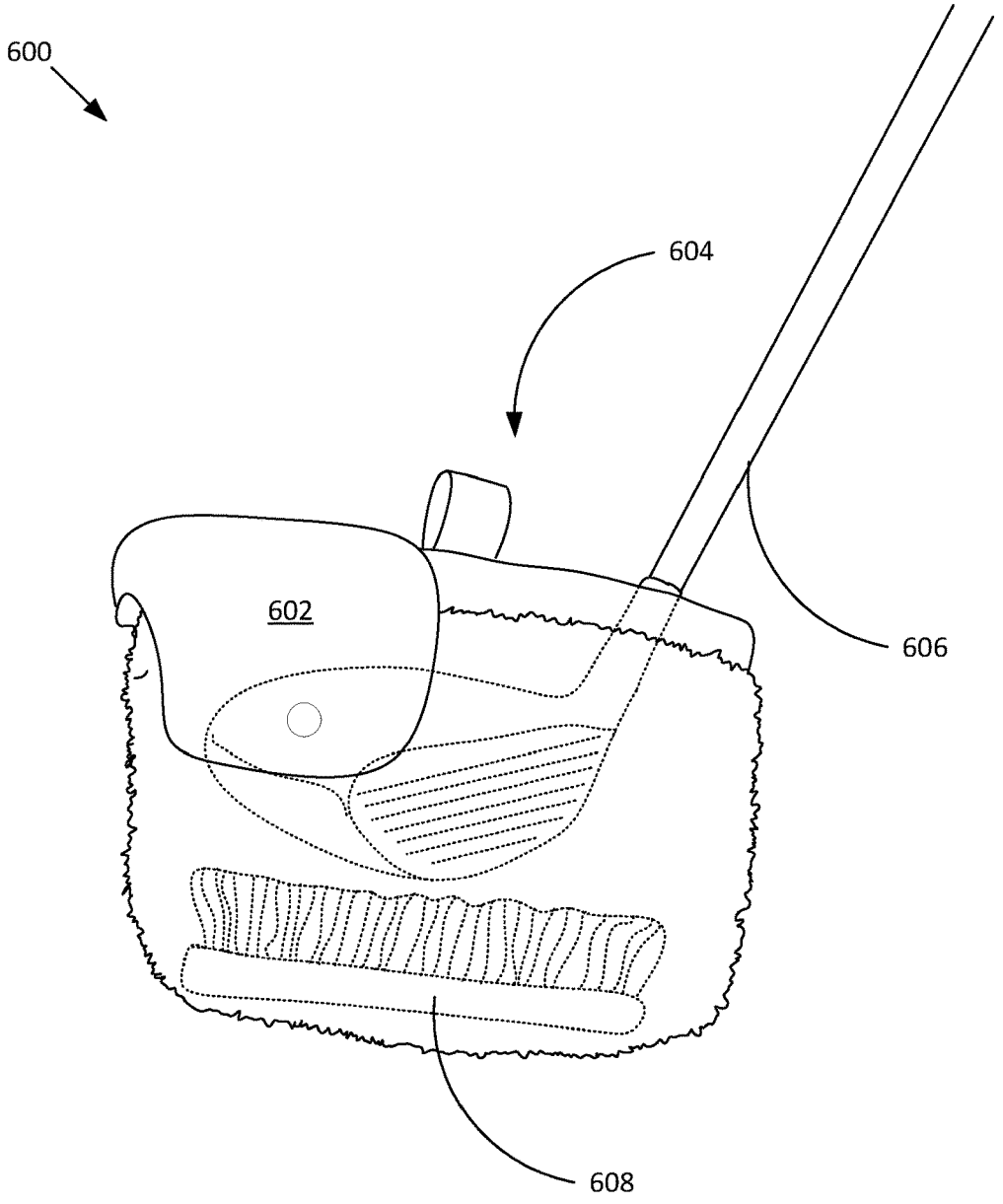
FIG. 6 is a side perspective view diagram illustrating another embodiment of a golf equipment cleaner in accordance with embodiments of the invention.

FIG. 6 is a side perspective view diagram illustrating another embodiment of a golf equipment cleaner 600 in accordance with embodiments of the invention. The golf equipment cleaner 600, as depicted, may be similar in size and material to the golf equipment cleaner 100 as described above in FIGS. 1-5. Additionally, the golf equipment cleaner 600 may be configured with a flap 602 for covering the opening 604. The flap 602 may be a partial flap that seals a portion of the opening 604, as depicted. This beneficially allows the golf equipment cleaner 600 to securely attach to, for example, a golf club 606. Alternatively, the flap 602 may extend along the entire length of the opening.

In one embodiment, a cleaning accessory 608 may be positioned within the golf equipment cleaner 600. For example, a brush may be positioned in the base of the golf equipment cleaner 600. The cleaning accessory 608 may be attached using adhesives, or fabric hook and loop fasteners.

Figure 7:
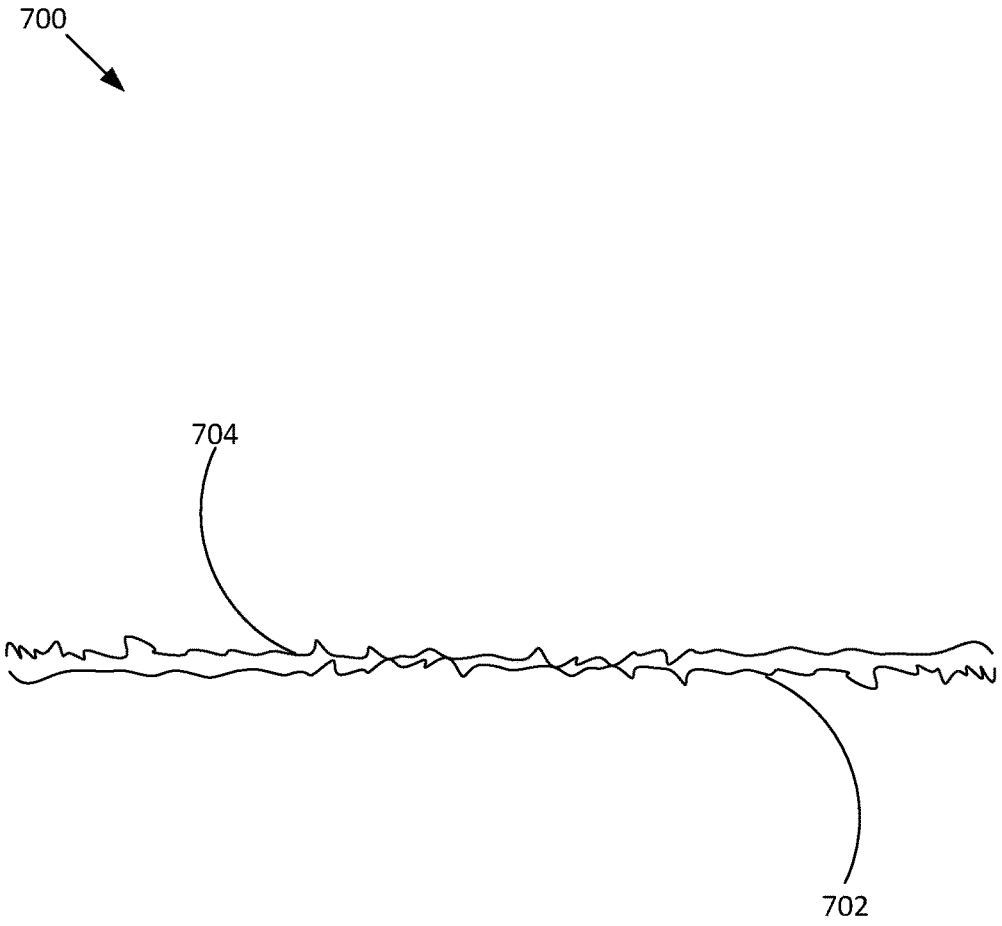
FIG. 7 is a cross-sectional diagram of an alternative embodiment of a cleaning layer in accordance with embodiments of the present invention.

FIG. 7 is a cross-sectional diagram of an alternative embodiment of a cleaning layer 700 in accordance with embodiments of the present invention. In one embodiment, the golf equipment cleaner may be formed of a single cleaning layer. Instead of inner and outer layers separated by a moisture barrier layer, the golf equipment cleaner may be formed of a single layer 700. The single layer 700 may have an inner water permeable surface 702 and an outer water impermeable surface 704. The outer water impermeable surface 704, in one embodiment, is a rubberized coating applied to one side of a cloth fabric, for example. In this example, the inner surface 702 may be moistened for cleaning debris from golf equipment, and the outer surface 704 functions to retain the moisture because the outer layer is water impermeable. As such, the moisture applied to the inner surface 702 is less likely to evaporate.

Figure 8:
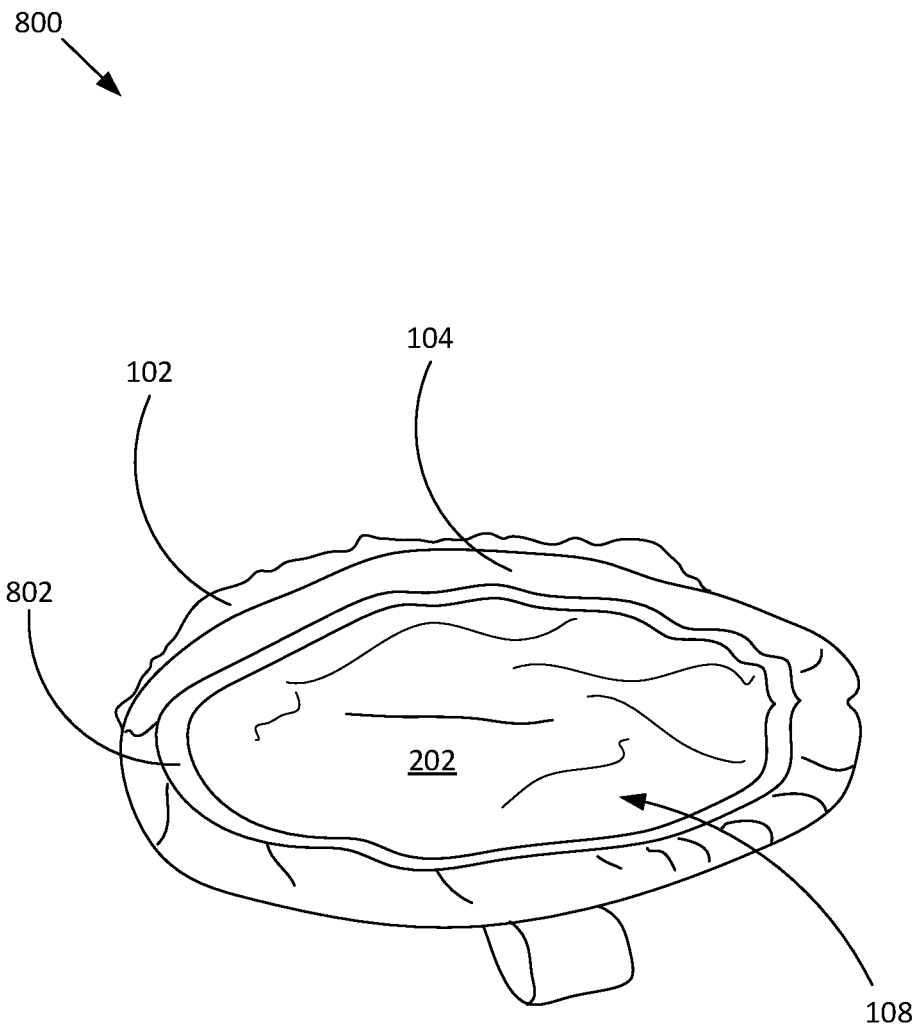
FIG. 8 is a top perspective view diagram illustrating one embodiment of the golf equipment cleaner in accordance with embodiments of the invention.

FIG. 8 is a top perspective view diagram illustrating one embodiment of the golf equipment cleaner 800. The golf equipment cleaner 800, as depicted, is formed with an opening 108 for receiving golf equipment such as golf balls or golf clubs. The opening 108 may be ringed, as described above, by the collar 104. The golf equipment cleaner may include the inner cleaning surface disposed inside.

In one embodiment, the golf equipment cleaner 800 may include an anti-wicking barrier 802. The anti-wicking barrier 802 may be disposed between the collar 104 and the inner cleaning surface 202. The anti-wicking barrier 802 may be disposed on the inside surface of the golf equipment cleaner 800. The anti-wicking barrier 802 may prevent moisture inside the golf equipment cleaner 800 (for example, moisture absorbed by the inner cleaning surface 202) from seeping, splashing, wicking, or the like onto the collar 104, the pouch, the outer cleaning surface 102, or the like. Moisture contacting the collar 104, the outer cleaning surface 102, or the like may cause a portion of the pouch to become wet or saturated with moisture, which may cause the collar 104 to become uncomfortable or difficult to hold or may cause the outer cleaning surface 102 to be less effective at drying a piece of golf equipment.

In some embodiments, the anti-wicking barrier 802 may include a water impermeable surface. The anti-wicking barrier 802 may include a water resistant or a waterproof material. For example, in one embodiment, the anti-wicking barrier 802 may include vinyl, polyvinyl chloride (PVC), polyurethane (including polyurethane laminate), rubberized plastic, nylon, silicone, or other water-resistant or waterproof material, or the like. The anti-wicking barrier 802 may be impregnated by rubber. The anti-wicking barrier 802 may include a flexible material that may bend with the opening or side-walls of the pouch.

In one embodiment, the anti-wicking barrier 802 may include a distance between the inner cleaning surface 202 and the collar 104. The distance may include a distance of ⅜ of an inch (approx. 9.5 mm), ½ of an inch (12.7 mm), or a distance smaller or larger than these distances. The distance may include a distance sufficient to prevent moisture inside the golf equipment cleaner 800 from contacting the collar 104.

Figure 9:
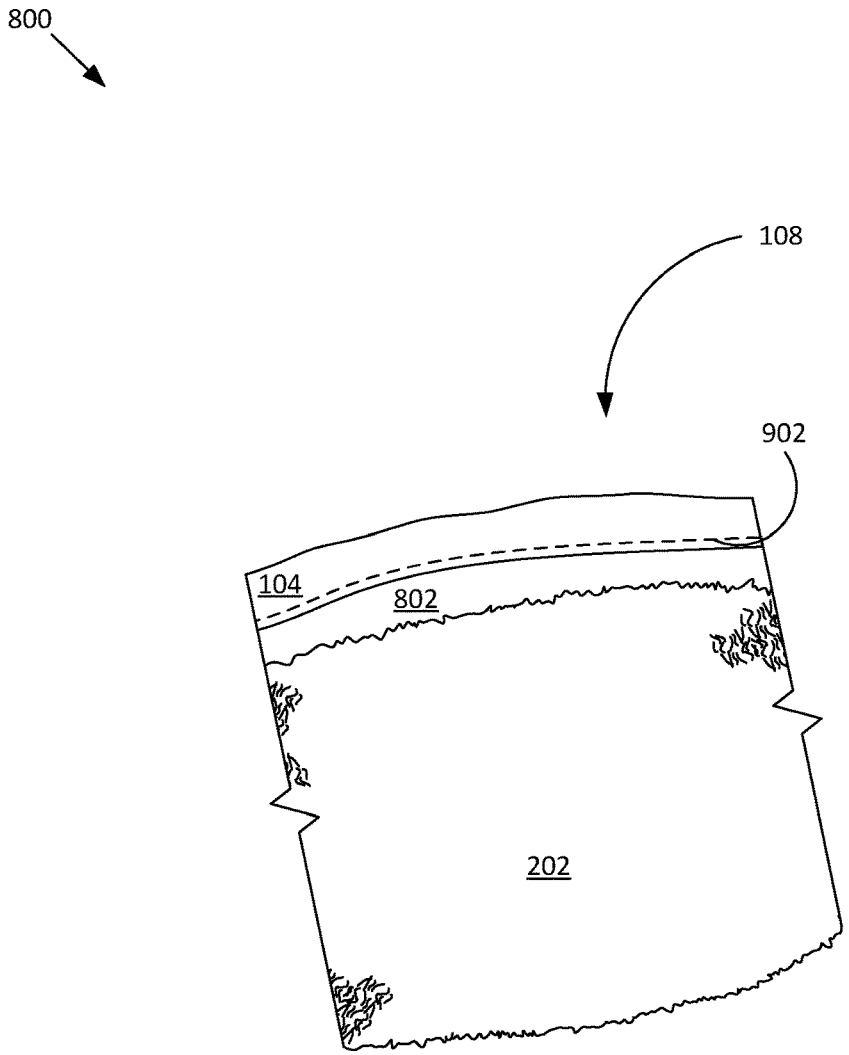
FIG. 9 is a perspective view diagram illustrating a portion of one embodiment of a golf equipment cleaner in accordance with embodiments of the invention.

FIG. 9 is a perspective view diagram illustrating a portion of the inside of one embodiment of the golf equipment cleaner 800. The golf equipment cleaner 800, as depicted, is formed with an opening 108 for receiving golf equipment such as golf balls or golf clubs. The opening 108 may be ringed, as described above, by the collar 104. The golf equipment cleaner 800 may include an anti-wicking barrier 802 disposed between the collar 104 and the inner cleaning surface 202.

In one embodiment, the golf equipment cleaner 800 may include a first stitching 902. The first stitching 902 may be disposed on the inside of the golf equipment cleaner 800 and/or the outside of the golf equipment cleaner 800. The first stitching 902 may couple the outer cleaning surface 102 to the collar 104. The first stitching 902 may couple the anti-wicking barrier 802 to the collar 104. The first stitching 902 may couple the moisture barrier 302 to the anti-wicking barrier 802, the collar 104, the inner cleaning surface, and/or the outer cleaning surface 102 as described below.

Figure 10:
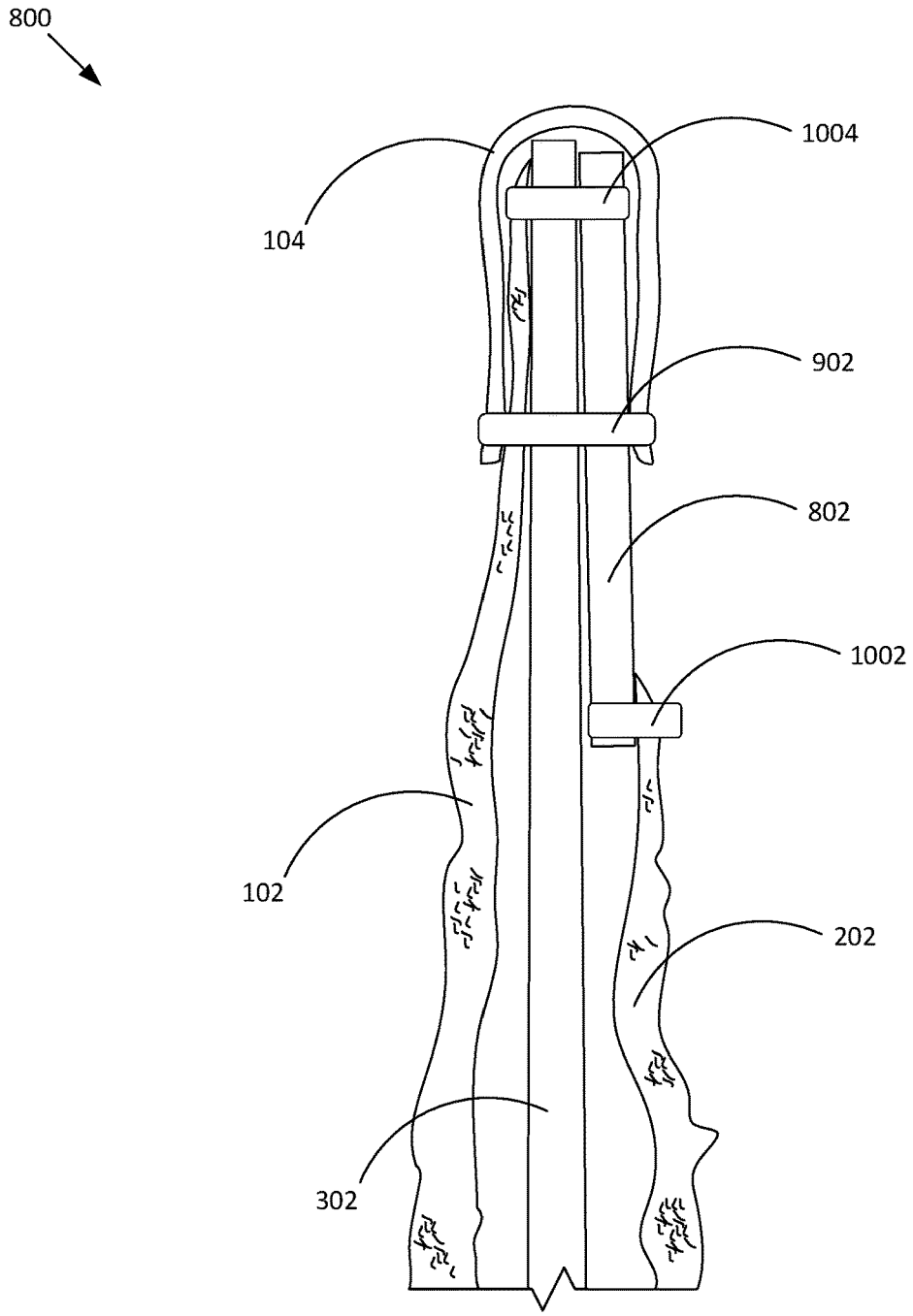
FIG. 10 is a cutaway side view diagram illustrating a portion of one embodiment of a golf equipment cleaner in accordance with embodiments of the invention.

FIG. 10 is a cutaway side view illustrating a portion of one embodiment of the golf equipment cleaner 800. The golf equipment cleaner 800 may include the outer cleaning surface 102, the inner cleaning surface 202, the moisture barrier 302 disposed between the outer cleaning surface 102 and the inner cleaning surface 202, the collar 104 ringing the opening 108 of the golf equipment cleaner 800, the anti-wicking barrier 802 disposed between the collar 104 and the inner cleaning surface 202, and the first stitching 902 as described above.

In one embodiment, as depicted in FIG. 10, the first stitching 902 may couple the outer end of the collar 104 to the outer cleaning surface 102, the outer cleaning surface 102 to the moisture barrier 302, the moisture barrier to the anti-wicking barrier 802, and the anti-wicking barrier 902 to the inner end of the collar 104.

In one embodiment, the golf equipment cleaner 800 may include a second stitching 1002. As depicted in FIG. 10, in one embodiment, the second stitching 1002 may couple the inner cleaning surface 202 to the anti-wicking barrier 802. In some embodiments, the second stitching 1002 may additionally couple the moisture barrier 302 to the anti-wicking barrier 802 and may additionally couple the moisture barrier 802 to the outer cleaning surface 102.

In one embodiment, the golf equipment cleaner 802 may include a third stitching 1004. As depicted in FIG. 10, in some embodiments, the third stitching 1004 may couple the outer cleaning surface 102 to the moisture barrier 302 and may couple the moisture barrier 302 to the anti-wicking barrier 302. In certain embodiments, the third stitching 1004 may couple one or more portions of the collar 104 to the outer cleaning surface 102 and/or the anti-wicking barrier 802.

In some embodiments, the first, second, and/or third stitchings 902, 1002, 1004 may each include a waterproof or water-resistant attachment. For example, a stitching may include a waterproof stitching, an adhesive, a seamless attachment, or the like. A seamless attachment may be free of holes, punctures, apertures, or the like. Holes, punctures, apertures, or the like in the anti-wicking barrier 802, the moisture barrier 302, or the like may allow moisture to move from inside the golf equipment cleaner 800, through the holes, and to the outer cleaning surface 102, which may cause the outer cleaning surface 102 to become wet or saturated with moisture. The outer cleaning surface 102 being wet or saturated may cause discomfort for the user when holding the outer cleaning surface 102 or may make it difficult for the user to hold the golf equipment cleaner 800.

In one embodiment, the golf equipment cleaner 800 may include a foam layer (not depicted) disposed between the inner cleaning surface 202 and the moisture barrier 302. The foam layer may absorb moisture poured into the opening 108. The foam layer may allow the golf equipment cleaner 800 to retain moisture for a longer time.

In some embodiments, the golf equipment cleaner 800 may be free of a collar 104. In some embodiments, the golf equipment cleaner 800 may be free of the anti-wicking barrier 802. In some embodiments, the water impermeable membrane 302 may extend past the inner cleaning surface 202 and may couple to the edge of the outer cleaning surface 102 or to the collar 104. The water impermeable membrane 302 may act as the anti-wicking barrier 802.

In one embodiment, a method for cleaning golf equipment may be included. The method may include providing a flexible outer layer shaped to form an exterior surface of a pouch. The flexible outer layer may include the outer cleaning surface 102. The flexible outer layer may include an edge.

The method may include providing a flexible inner layer shaped to form an interior surface of the pouch. The flexible inner layer may include the inner cleaning surface 202. The flexible inner layer may include an edge. The flexible inner layer may include a textured fabric for wet-cleaning golf equipment.

The method may include providing a water impermeable layer disposed between the flexible outer layer and the flexible inner layer. The water impermeable layer may include the moisture barrier 302. The water impermeable layer may include an edge and may be shaped to form an internal barrier of the pouch.

The method may include providing a collar that may couple the edges of the flexible outer layer, the flexible inner layer, and the water impermeable layer to form an opening of the pouch. The collar may include the collar 104.

The method may include providing a water impermeable surface disposed inside the pouch. The water impermeable surface may include the anti-wicking barrier 802. The water impermeable surface may be disposed between the collar and the flexible inner layer.

The method may include putting an amount of water into the pouch, inserting a piece of golf equipment through the opening into the pouch, and/or cleaning the piece of golf equipment using the flexible inner layer and the amount of water in the pouch.

In one embodiment, providing the water impermeable surface may include providing a material such as vinyl, rubberized plastic, polyvinyl chloride, polyurethane, silicone, or nylon. In one embodiment, providing the water impermeable surface may include providing a length of water impermeable material from the collar to the flexible inner layer of at least one half of an inch. In one embodiment, the method may include providing a foam layer between the flexible inner layer and the water impermeable layer.

Reference throughout this specification to features, advantages, or similar language does not imply that all of the features and advantages that may be realized with the subject matter of the present disclosure should be or are in any single embodiment. Rather, language referring to the features and advantages is understood to mean that a specific feature, advantage, or characteristic described in connection with an embodiment is included in at least one embodiment of the present disclosure. Thus, discussion of the features and advantages, and similar language, throughout this specification may, but do not necessarily, refer to the same embodiment.

Furthermore, the described features, advantages, and characteristics of the subject matter of the present disclosure may be combined in any suitable manner in one or more embodiments. One skilled in the relevant art will recognize that the subject matter may be practiced without one or more of the specific features or advantages of a particular embodiment. In other instances, additional features and advantages may be recognized in certain embodiments that may not be present in all embodiments. These features and advantages will become more fully apparent from the following description and appended claims, or may be learned by the practice of the subject matter as set forth hereinafter.

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Additionally, instances in this specification where one element is "coupled" to another element can include direct and indirect coupling. Direct coupling can be defined as one element coupled to and in some contact with another element. Indirect coupling can be defined as coupling between two elements not in direct contact with each other, but having one or more additional elements between the coupled elements. Further, as used herein, securing one element to another element can include direct securing and indirect securing. Additionally, as used herein, "adjacent" does not necessarily denote contact. For example, one element can be adjacent another element without being in contact with that element.

Furthermore, the details, including the features, structures, or characteristics, of the subject matter described herein may be combined in any suitable manner in one or more embodiments. One skilled in the relevant art will recognize, however, that the subject matter may be practiced without one or more of the specific details, or with other methods, components, materials, and so forth. In other instances, well-known structures, materials, or operations are not shown or described in detail to avoid obscuring aspects of the disclosed subject matter.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An apparatus for cleaning golf equipment comprising:

a flexible outer layer shaped to form an exterior surface of a pouch, wherein the flexible outer layer comprises an edge;

a flexible inner layer shaped to form an interior surface of the pouch, wherein the flexible inner layer comprises an edge, the flexible inner layer comprising a textured fabric for wet-cleaning golf equipment;

a water impermeable layer disposed between the flexible outer layer and the flexible inner layer, the water impermeable layer comprises an edge and is shaped to form an internal barrier of the pouch;

a collar coupling the edges of the flexible outer layer, the flexible inner layer, and the water impermeable layer to form an opening of the pouch; and a water impermeable surface disposed inside the pouch, the water impermeable surface being disposed between the collar and the flexible inner layer, wherein water is retainable within the pouch;

wherein the water impermeable surface comprises a length from the collar to the textured fabric layer of at least one eighth of an inch.

2. The apparatus of claim 1, wherein the water impermeable surface comprises a vinyl.

3. The apparatus of claim 1, wherein the water impermeable surface comprises a rubberized plastic.

4. The apparatus of claim 1, wherein the water impermeable surface comprises at least one of:

polyvinyl chloride;
polyurethane;
silicone; and
nylon.

5. The apparatus of claim 1, wherein the water impermeable surface comprises a length from the collar to the flexible inner layer greater than one eighth of an inch.

6. The apparatus of claim 1, further comprising a coupling that couples together the edge of the flexible outer layer, the water impermeable membrane, and flexible inner layer.

7. The apparatus of claim 1, wherein the textured fabric comprises at least one of:

terry cloth;
microfiber;
neoprene; and
spandex.

8. The apparatus of claim 1, further comprising a foam layer disposed between the flexible inner layer and the water impermeable layer.

9. An apparatus for cleaning golf equipment comprising:

a water impermeable membrane shaped to form a pouch, wherein the pouch comprises an opening, side-walls, and a bottom;

a textured fabric layer lining interior surfaces of the side-walls and the bottom of the pouch;

a collar that couples the textured fabric layer to the water impermeable membrane and borders the opening of the pouch; and a water impermeable surface disposed inside the pouch, the water impermeable surface being disposed between the collar and the textured fabric layer;

wherein the water impermeable surface comprises a length from the collar to the textured fabric layer of at least one eighth of an inch.

10. The apparatus of claim 9, wherein the water impermeable surface comprises at least one of:

vinyl;
rubberized plastic;
polyvinyl chloride;
polyurethane;
silicone; and
nylon.

11. The apparatus of claim 9, wherein the water impermeable surface comprises a length from the collar to the textured fabric layer greater than one eighth of an inch.

12. The apparatus of claim 9, wherein the collar comprises a stitching that couples the textured fabric layer to the water impermeable membrane.

13. The apparatus of claim 9, wherein the textured fabric layer comprises at least one of:

terry cloth;
microfiber;
neoprene; and
spandex.

14. The apparatus of claim 9, further comprising a foam layer disposed between the water impermeable membrane and the textured fabric layer.

15. A method for cleaning golf equipment comprising:

providing a flexible outer layer shaped to form an exterior surface of a pouch, wherein the flexible outer layer comprises an edge;

providing a flexible inner layer shaped to form an interior surface of the pouch, wherein the flexible inner layer comprises an edge, the flexible inner layer comprising a textured fabric for wet-cleaning golf equipment;

providing a water impermeable layer disposed between the flexible outer layer and the flexible inner layer, the water impermeable layer comprises an edge and is shaped to form an internal barrier of the pouch;

providing a collar coupling the edges of the flexible outer layer, the flexible inner layer, and the water impermeable layer to form an opening of the pouch;

providing a water impermeable surface disposed inside the pouch, the water impermeable surface being disposed between the collar and the flexible inner layer;

putting an amount of water into the pouch;

inserting a piece of golf equipment through the opening into the pouch; and cleaning the piece of golf equipment using the flexible inner layer and the amount of water in the pouch;

wherein providing the water impermeable surface further comprises providing a length of water impermeable material from the collar to the flexible inner layer of at least one eighth of an inch.

16. The method of claim 15, wherein providing the water impermeable surface further comprises providing a material comprising at least one of:

vinyl;
rubberized plastic;
polyvinyl chloride;
polyurethane;
silicone; and
nylon.

17. The method of claim 15, further comprising providing a foam layer between the flexible inner layer and the water impermeable layer.

* * * * *